United States Patent [19]

Kobayashi

[11] Patent Number: 4,979,753

[45] Date of Patent: Dec. 25, 1990

[54] ACTION TOY GAME DEVICE

[75] Inventor: Toshio Kobayashi, Chiba, Japan

[73] Assignee: Asahi Corporation, Tokyo, Japan

[21] Appl. No.: 433,891

[22] Filed: Nov. 9, 1989

[30] Foreign Application Priority Data

Mar. 10, 1989 [JP] Japan ..... 1-27862[U]

[51] Int. Cl.[5] ..... A63B 67/00; A63F 9/00

[52] U.S. Cl. ..... 273/399; 273/1 R

[58] Field of Search ..... 273/399, 400, 401, 402, 273/354, 1 GE, 1 GF, 1 GD

[56] References Cited

U.S. PATENT DOCUMENTS

| | | | |
|---|---|---|---|
| 3,132,864 | 5/1964 | Glass et al. | 273/127 R |
| 3,794,325 | 2/1974 | Stender | 273/399 |
| 4,109,914 | 8/1978 | Matsumoto | 273/354 |
| 4,620,706 | 11/1986 | Ijidakinro | 273/122 R |
| 4,783,074 | 11/1988 | Kobayashi | 273/1 GF X |
| 4,802,668 | 2/1989 | Kobayashi | 273/1 GE |
| 4,826,160 | 2/1989 | Kobayashi | 273/1 GE |
| 4,826,176 | 5/1989 | Kobayashi | 273/354 |
| 4,880,231 | 11/1989 | Kobayashi | 273/1 GD |
| 4,883,273 | 11/1989 | Kobayashi | 273/1 GE X |

*Primary Examiner*—William H. Grieb

*Attorney, Agent, or Firm*—Salter & Michaelson

[57] ABSTRACT

An action toy game device includes a base, a timer on the base, a receiving wall having a receiving opening therein on the base, a plurality of game elements, and a propelling mechanism for propelling the game elements toward the receiving wall so that they are receivable in the receiving opening. The timer is actuatable for set periods of time and it is operative for oscillating the receiving wall between obstructed and unobstructed positions wherein the receiving opening is obstructed and unobstructed, respectively. Game play is effected by actuating the timer and propelling the game elements toward the receiving opening at times when the receiving opening is in the unobstructed position so that the game elements are receivable in the receiving opening.

5 Claims, 4 Drawing Sheets

ACTION TOY GAME DEVICE

BACKGROUND AND SUMMARY OF THE INVENTION

The instant invention relates to games and more particularly to an action toy game device of the general type wherein a game player must perform certain prespecified game activities within a set period of time in order to achieve a game score.

It has generally been found that action toy game devices which require game players to perform certain prespecified manipulative game activities within set periods of time have relatively high levels of play value and appeal. For example, the devices disclosed in the applicants U.S. Pat. Nos. 4,783,074; 4,802,668; 4,826,160; and 4,826,176 and patent applications Nos. 07/273,221; 07/273,222; and 07/273,223 have been found to be highly effective and popular game devices which have high levels of amusement value. In this connection, the devices disclosed in these U.S. patents and applications incorporate a variety of different and amusing types of action movements and they generally require a variety of different and challenging types of manipulations to achieve game scores. For these reasons, they have been found to be highly successful and popular amusement game devices.

Devices which, in addition to those disclosed in the applicant's aforementioned U.S. patents and patent applications, represent the closest prior art to the subject invention of which the applicant is aware are disclosed in the U.S. Patents to Glass et al U.S. Pat. No. 3,132,864; Stender U.S. Pat. No. 3,794,325; Matsumoto U.S. Pat. No. 4,109,914; and Ijidakinro No. 4,620,706 and the British patent to Hayes et al U.S. Pat. No. 1,568,410. However, since the devices disclosed in these references fail to suggest an amusement toy game device which incorporates the novel and amusing action movements of the device of the subject invention, they are believed to be of only general interest with respect thereto.

The instant invention provides an action toy game device which incorporates highly interesting and amusing forms of action movement and which requires skillful manipulations to achieve game scores. Specifically, the action toy game device of the instant invention comprises a base, a timer on the base which is actuatable for set periods of time, a plurality of game elements, receiver means on the base and means for propelling the game elements toward the receiver means. The receiver means includes a receiving wall having a receiving opening therein for receiving the game elements and the receiver means communicates with the timer means for oscillating the receiving wall between first and second positions wherein the receiving opening is unobstructed and obstructed, respectively, during the set periods of time. The receiving wall preferably faces substantially upwardly when it is in the first position thereof and angularly upwardly and at least partially away from the propelling means when it is in the second position thereof. The receiver means preferably further comprises a substantially stationary target wall and means on the target wall for obstructing the receiving opening when the receiving wall is in the second position thereof. The receiving wall is preferably pivotally mounted for movement between the first and second positions thereof and the receiver means preferably further comprises a character face element which moves with the receiving wall as the receiving wall is moved between the first and second positions thereof. The character face element is preferably disposed beneath the receiving wall and it is preferably concealed when the receiving wall is in the first position thereof. The character face element preferably moves upwardly with the receiving wall as the receiving wall is moved toward the second position thereof so that the character face element is exposed when the receiving wall reaches the second position thereof.

For use in operation of the action toy game device of the subject invention the timer means is actuated for a set period of time so that the receiving wall is oscillated between the first and second positions thereof and the character face element is moved between concealed and exposed positions as the timer means is advanced toward an unwound position. As the timer means is advanced toward the unwound position, the propelling means can be manipulated by a game player to propel the game elements toward the target wall of the receiving means. In this regard, since the receiving wall oscillates between the first and second positions thereof as the timer means is advanced toward an unwound position, the operation of the propelling means must be precisely timed with the movement of the receiving wall so that the game elements are propelled toward the receiving opening when the receiving wall is in the first position thereof. Further, the propelling means must be carefully manipulated with an appropriate amount of force to enable the game elements to be received in the receiving opening when the receiving wall is in the first position thereof. Accordingly, the game device of the subject invention requires a high level of skill and coordination to achieve game scores by propelling the game elements toward the target wall so that they are actually received in the receiving opening.

Accordingly, it is a primary object of the instant invention to provide an amusing and challenging action toy game device.

Another object of the instant invention is to provide an amusing game device wherein game elements are propelled at a target wall so that they are received in a receiving opening in order to achieve game scores.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
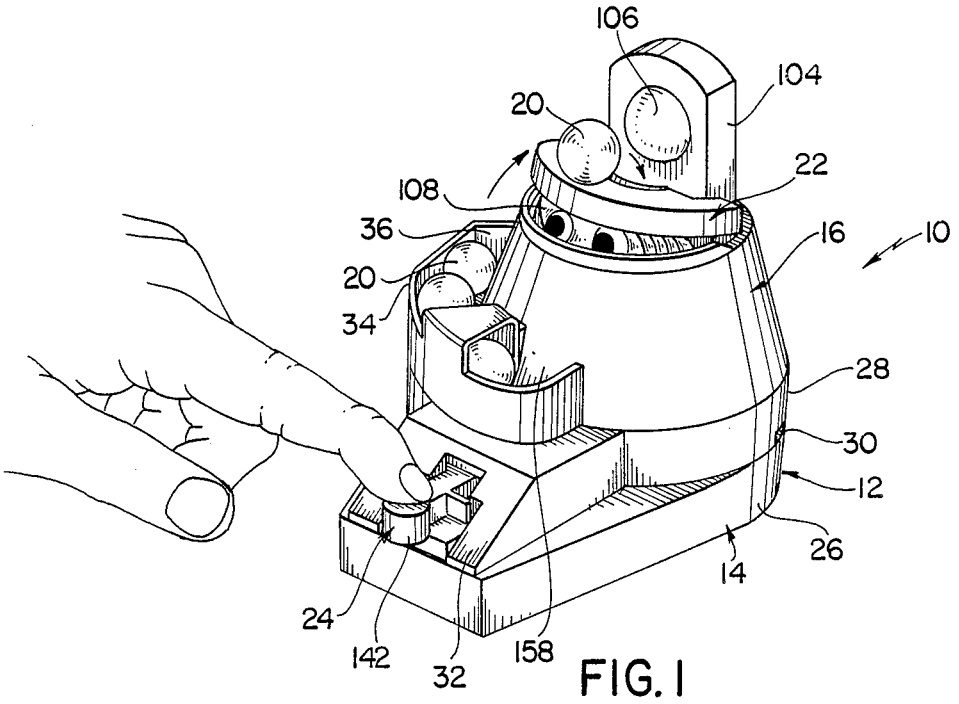
FIG. 1 is a perspective view illustrating the operation of the action toy game device of the instant invention.

Referring now to the drawings, the action toy game device of the instant invention is illustrated in FIGS. 1–9 and generally indicated at 10 in FIGS. 1–5. The device 10 comprises a base generally indicated at 12 including a lower housing section generally indicated at 14 and an upper housing section generally indicated at 16, a timer assembly generally indicated at 18 in the base 12, a plurality of game elements 20, a receiving assembly generally indicated at 22 and a propelling mechanism generally indicated at 24. During operation of the game device 10 the timer assembly 18 is actuatable for set periods of time and the receiving assembly 22 communicates with the timer assembly 18 for oscillating the receiving assembly 22 between the first or unobstructed position thereof illustrated in FIG. 4 and the second or obstructed position thereof illustrated in FIG. 5. The propelling mechanism 24 is operable for propelling the game elements 20 so that they are receivable in the receiving assembly 22 when the receiving assembly 22 is in the first or unobstructed position thereof but not when it is in the second or obstructed position thereof.

The base 12 includes the lower and upper housing sections 14 and 16, respectively, which cooperate to define a housing structure for the internal components of the game device 10. The lower housing section 14 includes lower and upper portions 26 and 28, respectively which cooperate to define an elongated slot 30 for the operating lever of the timer assembly 18. The slot 30 extends across the rear portion of the lower housing section 14 and a propelling assembly housing section 33 is formed in the lower housing section 14 in the front portion of the game device 10. The upper housing section 16 is mounted on the lower housing section 14 and it tapers upwardly to the receiving assembly 22. The upper housing section 16 includes a channel wall 34 which defines a game element channel 36. The game element channel 36 is inclined downwardly and forwardly and it is dimensioned for receiving and containing a supply of the game elements 20 so that the game elements 20 can roll downwardly toward the propelling mechanism 24. An access door 37 is provided in the upper housing section 16 for retrieving game elements 20 from the interior of the base 12 after the game elements 20 have been received in the receiving mechanism 22.

Figure 7:
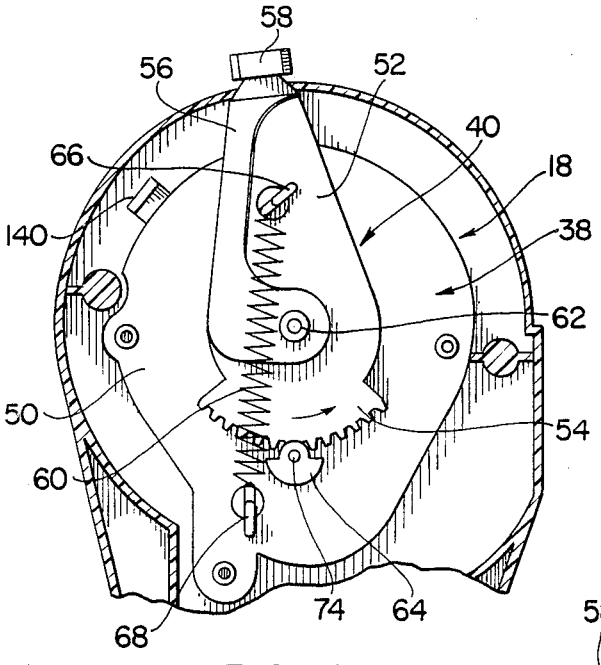
FIG. 7 is a sectional view taken along line 7—7 in FIG. 5.
Figure 8:
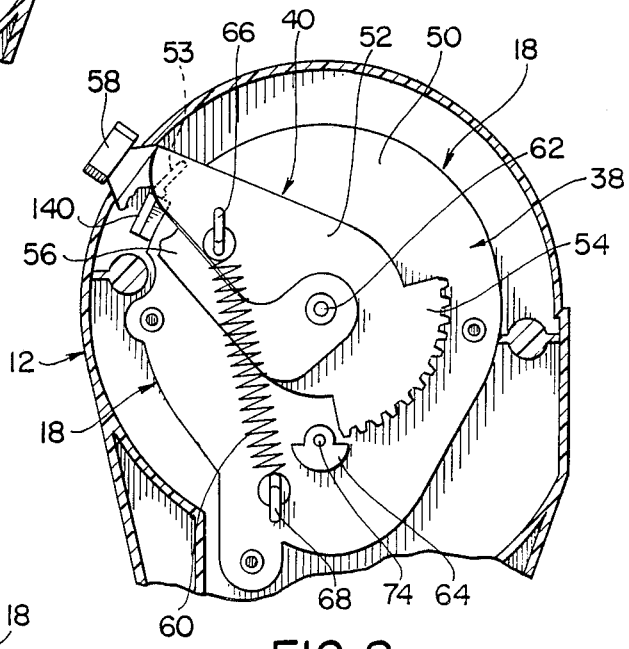
FIG. 8 is a similar view with the timer in a fully unwound position.
Figure 9:
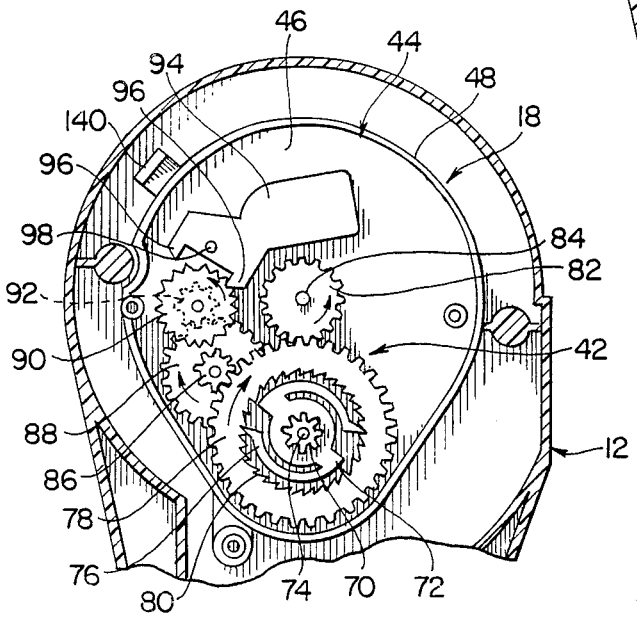
FIG. 9 is a sectional view taken along line 9—9 in FIG. 5.

The timer assembly 18 is illustrated most clearly in FIGS. 7–9 and it includes a timer housing generally indicated at 38, a winding mechanism generally indicated at 40, and a decay mechanism generally indicated at 42. The housing 38 includes a main or upper housing section 44 having an upper wall 46 and a peripheral side wall 48, and a lower wall 50. The winding mechanism 40 is mounted on the underside of the lower wall 50, whereas the decay mechanism 42 is mounted on the underside of the upper wall 46 in the interior of the main housing section 44. During operation of the timer assembly 18 the winding mechanism 40 is manually actuatable for driving the decay mechanism 18 so that the decay mechanism 18 oscillates the receiving assembly 22 back and forth as will hereinafter be more fully set forth.

The winding mechanism 40 includes a main winding arm 52 having an upwardly extending leg 53 and a fan gear 54 thereon, a secondary winding arm 56 including a winding knob 58, and a main drive spring 60. The main winding arm 52 is rotatably mounted on a hub 62 on the lower wall 50 so that the fan gear 54 passes through an open drive gear housing 64 on the lower wall 50. Lugs 66 and 68 are provided on the main drive gear 52 and on the lower wall 50, respectively, and the spring 60 extends between the lugs 66 and 68 for driving the main winding arm 52 in the direction illustrated in FIG. 7. The secondary winding arm 56 is also rotatably mounted on the hub 62 and it is constructed so that it is engageable with the main winding arm 52 to advance the winding arm 52 toward a fully wound position, i.e. in a direction opposite to that illustrated in FIG. 7. However, the secondary winding arm 56 is constructed so that when it is moved toward an unwound position (rotated in a counter-clockwise direction as illustrated in FIG. 7–8) it is independently moveable without advancing the main winding arm toward an unwound position. Accordingly, while the secondary winding arm is engageable with the main winding arm 52 to effect winding of the timer assembly 18, the secondary winding arm 56 cannot be used for advancing the timer assembly 18 toward an unwound position at a rate which is faster than that dictated by the decay mechanism 42.

The decay mechanism 42 is illustrated most clearly in FIG. 9 and it includes a main drive gear 70 which is integrally formed with a ratchet ring 72 and mounted on a shaft 74 so that the main drive gear 70 is positioned in the open drive gear housing 64 for communicating with the fan gear 54. The ratchet ring 72 includes ratchet arms 76 and it is mounted in the interior of a ratchet ring gear 78 having interior ratchet teeth 80. The ratchet arms 76 are constructed so that they are engageable with the teeth 80 for advancing the ring gear 78 in the direction illustrated but so that they pass over the teeth 80 when the ratchet ring 72 is rotated in a reverse direction. Accordingly, when the main drive gear 70 is rotated by the fan gear 54 as the main winding arm 52 is advanced toward an unwound position, the ratchet arms 76 engage the teeth 80 to rotate the ratchet ring gear 78 in the direction illustrated, whereas when the main winding arm 52 is manually advanced toward a wound position, the ratchet arms 76 pass over the teeth 80 so that rotation is not communicated to the ratchet ring gear 78. Also included in the decay mechanism 42 is a receiving mechanism driving gear 82. The receiving mechanism drive gear 82 is mounted on a shaft 84 which extends upwardly through the upper wall 46 so that it communicates with the ratchet ring gear 78 for rotating the shaft 84. The decay mechanism 42 further includes a reduced transmission gear 86 which is integrally formed with an enlarged transmission gear 88 and an escapement wheel 90 which is integrally formed with an escapement wheel drive gear 92. The reduced transmission gear 86 communicates with the ratchet ring gear 78 and the enlarged transmission gear 88 communicates with the escapement wheel drive gear 92 for rotating the escapement wheel 90 when the ratchet ring gear 78 is rotated in the direction illustrated. The decay mechanism 42 still further includes an escapement member 94 having a pair of jaws 96. The escapement member 94 is pivotally mounted on a shaft 98 so that the jaws 96 are alternately engageable with different teeth on the escapement wheel 90 causing the escapement member 94 to oscillate back and forth to retard the movement of the decay mechanism 42 as it is advanced toward an unwound position.

The game elements 20 preferably comprise substantially spherical ball elements which are preferably molded from a suitable plastic material.

Figure 2:
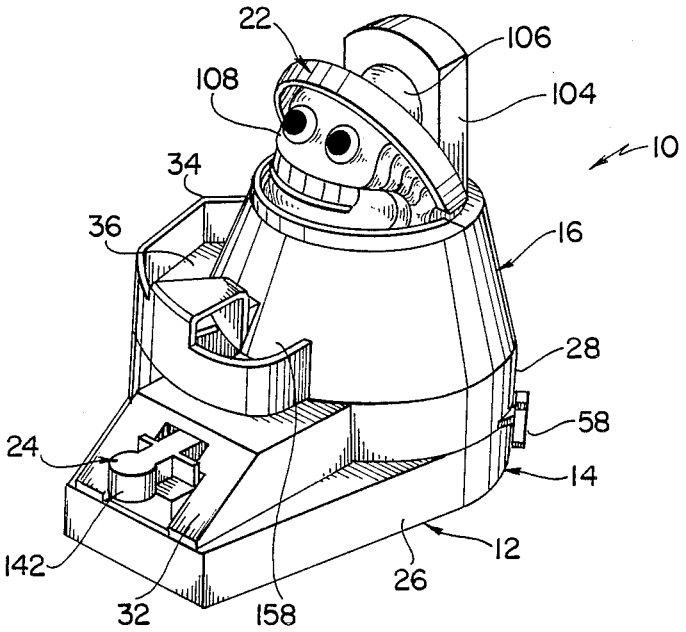
FIG. 2 is a similar perspective view with the receiving wall in the second position thereof.
Figure 3:
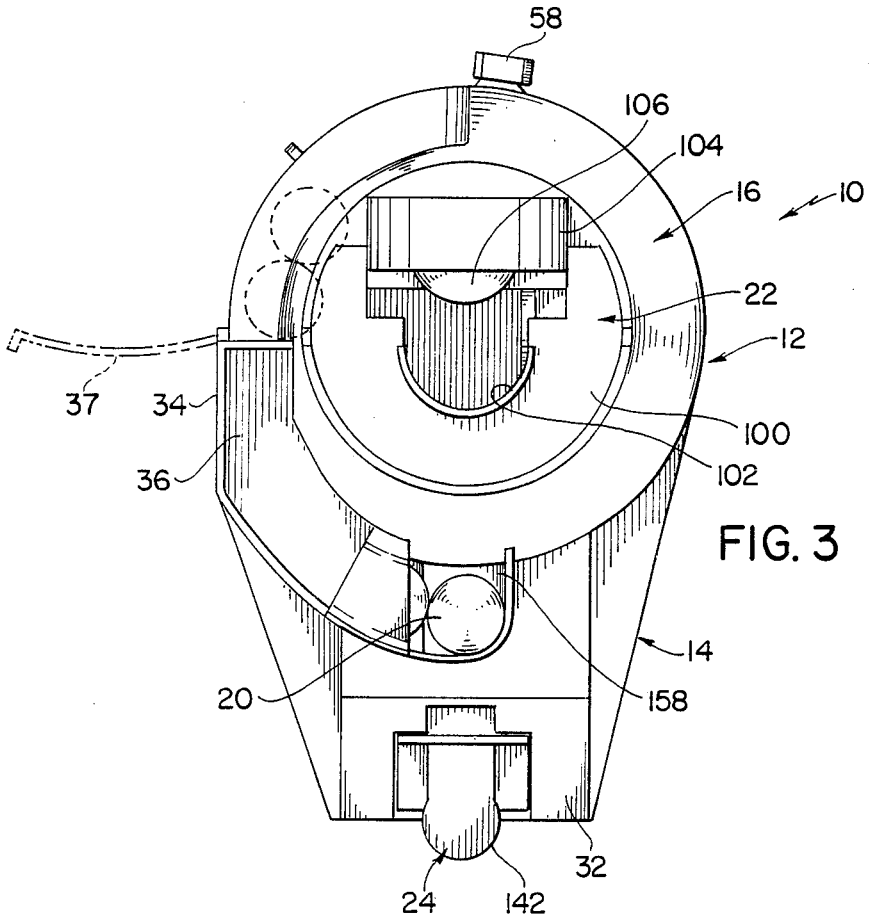
FIG. 3 is a top plan view of the game device.
Figure 4:
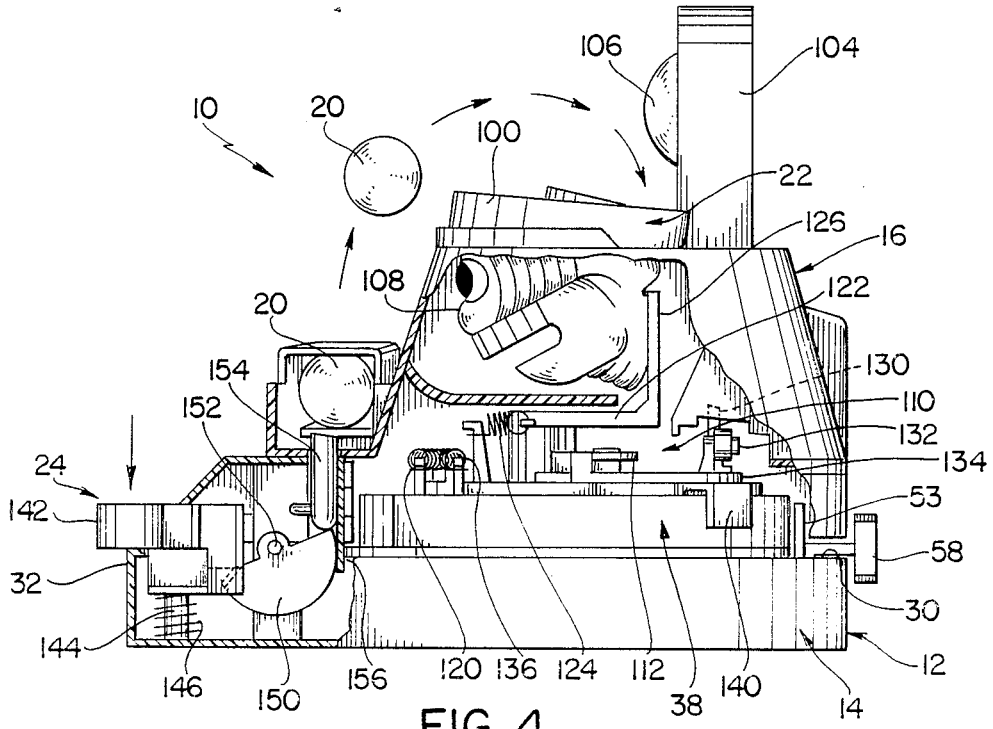
FIG. 4 is a side elevational view of the game device shown partially in section with the receiving wall in the first position thereof.
Figure 5:
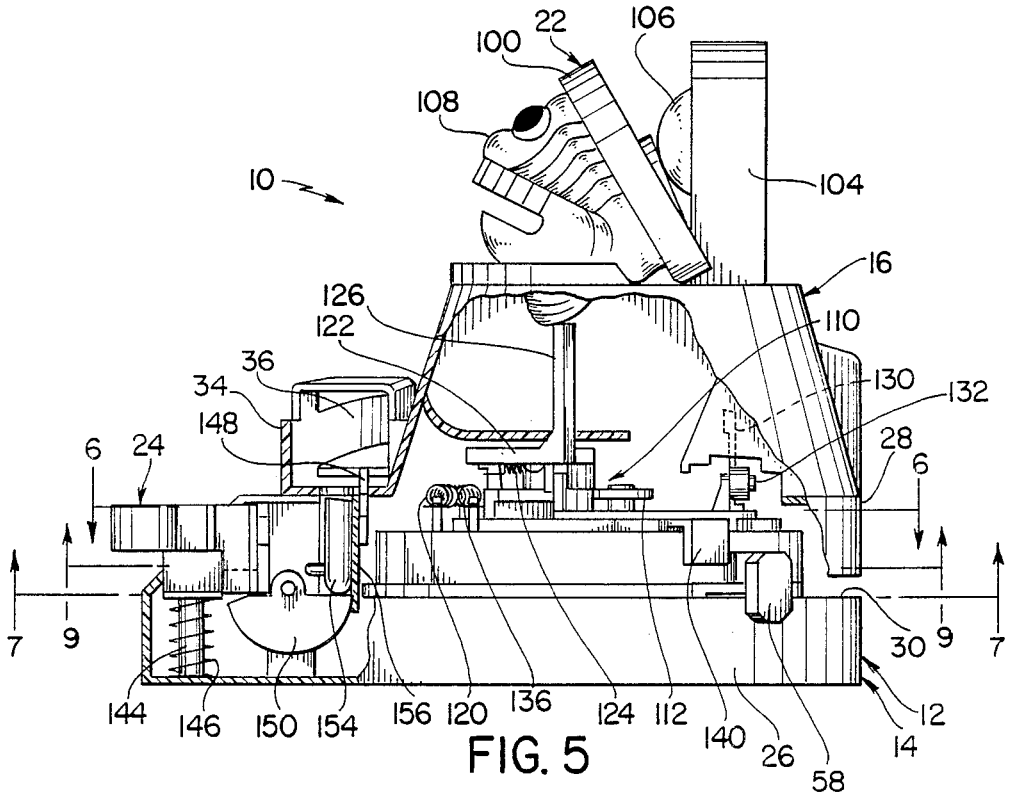
FIG. 5 is a similar view with the receiving wall in the second position thereof.

The receiving mechanism 22 is illustrated most clearly in FIGS. 1–6. The receiving mechanism 22 includes a receiving wall 100 having a receiving opening 102 formed therein, a target wall 104 having a target element 106 formed thereon, a character face element 108 and a receiving mechanism actuating assembly 110. The receiving wall 100 is pivotally mounted at the upper end of the upper housing section 16 so that it is pivotable between a first or unobstructed position wherein the receiving wall 100 is substantially horizontal and a second or obstructed position wherein it is pivoted angularly upwardly and away from the propelling mechanism 24. The target wall 104 extends upwardly from the upper end of the upper housing section 16 adjacent the rear extremity of the receiving wall 100 so that the receiving wall 100 pivots upwardly and toward the target wall 104 as it is moved toward the second or obstructed position thereof. The target element 106 is preferably formed in substantially the center of the target wall 104 and it projects forwardly therefrom so that it obstructs the receiving opening 102 when the receiving wall 100 is in the obstructed position thereof. However, the target element 106 is formed so that when the receiving wall 100 is in the substantially horizontal unobstructed position thereof the game elements 20 are receivable in the interior of the upper housing section 16 through the receiving opening 102. The character face element 108 is preferably formed as an amusing character figure and it is attached to the underside of the receiving wall 100 so that when the receiving wall 100 is in the first or unobstructed position thereof the character face element 108 is concealed in the interior of the upper housing section 16. However, when the receiving wall 100 is pivoted upwardly to the obstructed or second position thereof the character face element 108 is clearly visible as illustrated in FIGS. 2 and 5.

Figure 6:
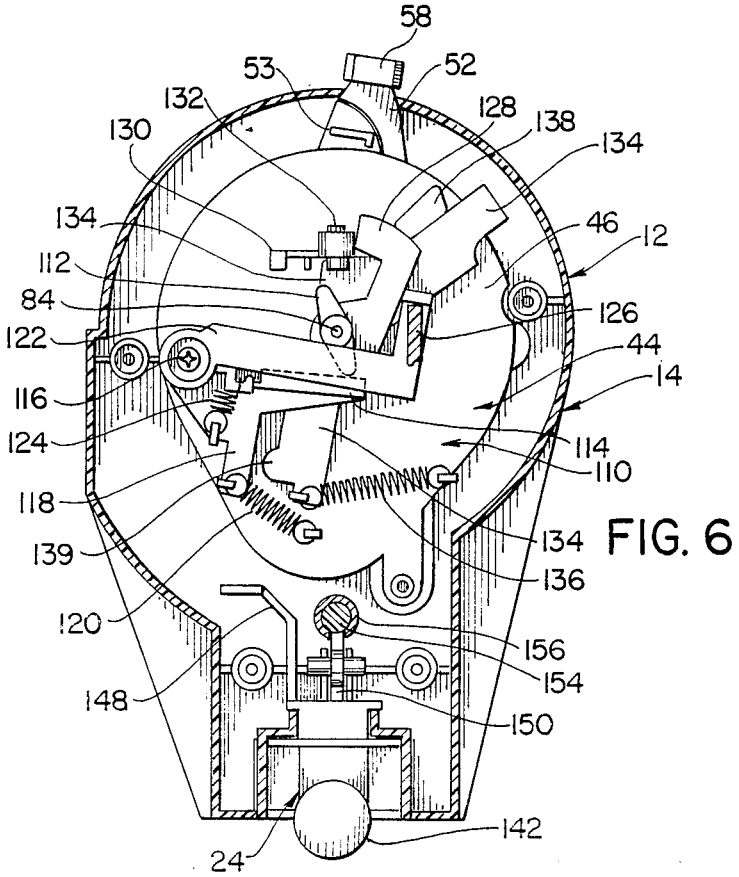
FIG. 6 is a sectional view taken along line 6—6 in FIG. 5.

The receiving mechanism actuating assembly 110 is illustrated most clearly in FIGS. 4–6 and it is operative for moving the receiving wall 100 between the obstructed and unobstructed positions thereof. The actuating assembly 110 comprises an elongated cam element 112 which is mounted on the shaft 84 on the upper side of the upper wall 46 of the timer housing 44 and a follower arm 114 which is pivotally mounted on the upper side of the wall 46 with a screw 116. The follower arm 114 includes a lever portion 118 which is connected to a spring 120 attached to the upper wall 46. The spring 120 biases the follower arm 114 to a position of engagement with the cam element 112 so that the follower arm 114 oscillates back and forth about the axis of the screw 116 as the cam element 112 is rotated. A connector arm 122 is also pivotally mounted about the axis of the screw 116 and it is biased toward a position of engagement with the follower arm 114 by a spring 124, although it is pivotable outwardly away from the follower arm 114 against the force of the spring 124. Accordingly, during normal operation the connector arm 122 follows the movement of the follower arm 114, although it is manually moveable in a direction away from the follower arm 114 against the force of the spring 124. An actuating member 126 is integrally formed with the connecting arm 122 so that it extends upwardly therefrom as illustrated in FIGS. 4–5. The actuating member 126 is positioned and formed so that it is engageable with the character face element 108 for pivoting the character face element 108 and the receiving wall 100 between the obstructed and unobstructed positions illustrated in FIGS. 5 and 4, respectively. In this regard, during normal operation, whenever the shaft 84 is rotated by the timer mechanism 18, the cam element 112 is rotated on the upper side of the upper timer housing wall 46 so that the follower arm 114 and the connector arm 122 oscillate back and forth to move the actuator arm 126 back and forth. Since the actuator arm 126 normally engages the character face element 108, the actuator arm 126 normally causes the character face element 108 and the receiving wall 100 to oscillate back and forth between the obstructed and the unobstructed positions thereof. However, because the connector arm 122 is separable from the follower arm 114, the receiving wall 100 and the character face element 108 can be manually held in the unobstructed positions thereof without causing damage to either the receiving member actuating assembly 110 or the timer assembly 18.

Also included in the receiving mechanism actuating assembly 110 is a stop lever 128 which is pivotally mounted about the axis of the shaft 84 and communicates with the connecting arm 122 at a point which is spaced outwardly slightly from the axis of the screw 116 so that the connecting arm 122 oscillates in the opposite direction from the follower arm 114 as the cam 112 is rotated. The stop lever 128 is engageable with a stop member 130 which is pivotally mounted about a substantially horizontal axis 132 and a shut-off lever 134. The shut-off lever 134 is also pivotally mounted about the axis of the shaft 84 and it is biased by a spring 136 to a position wherein the shut-off lever 134 engages a stop 138 on the upper side of the upper timer housing wall 46. Formed on the shut-off lever 134 adjacent one end thereof is a rounded bump 139 and a downwardly extending shut off leg 140 is formed on the shut-off lever 134 adjacent to the opposite end thereof. The downwardly extending leg 140 extends downwardly along the outer side of the timer housing 44 and it is positioned so that it is engageable by the upwardly extending leg 53 on the main winding arm 52 when the fan gear 54 is disengaged from the main drive gear 70 as the winding arm 52 approaches the fully unwound position thereof. Accordingly, as the winding mechanism 18 approaches the fully unwound position thereof the upwardly extending leg 53 on the main winding arm 52 engages the downwardly extending leg 140 on the shut-off lever 134 to pivot the shut-off lever 134 to a position wherein the bump 139 engages the lever portion 118 of the follower arm 114 to pivot the follower arm 114 and the connector arm 122. As the connector arm 122 is pivoted in this manner the actuator member 126 is moved forwardly so that it engages the character element 108 to pivot the receiving wall 100 upwardly to the fully obstructed position thereof. Simultaneously, as the follower arm 114 is pivoted by the shut-off lever 134 the stop lever 128 is pivoted to a position wherein it engages the stop element 130 to pivot the stop element 130 upwardly to the position illustrated in FIG. 5. When the stop element 130 is in this position it obstructs the passage of game elements 20 through the interior of the upper housing section 16 so that any game elements 20 remaining in the interior of the upper housing section 16 are prevented from gravitating downwardly to the access door 37.

The propelling mechanism 24 is illustrated most clearly in FIGS. 1–6 and it includes a plunger member 142 which is received on a post 144 extending upwardly from the bottom wall of the lower housing section 26. A biasing spring 146 biases the plunger number 142 to the upwardly disposed position illustrated in FIG. 4. Integrally formed with the plunger member 142 is a positioning leg 148 which extends upwardly in the channel 36 when the plunger member 142 is in a non-depressed position. Also included in the propelling mechanism 24 is an arcuate segment 150 which is pivotally mounted in the lower housing section 26 so that it is engageable by the plunger member 142 for pivoting the arcuate segment 150 about a pivot axis 152. The arcuate segment 150 communicates with a propelling pin 154 which travels in a tubular element integrally formed in the upper housing section 28. The arcuate segment 150 and the plunger element 142 are assembled so that they cooperate for advancing the propelling pin 154 upwardly as the plunger element 142 is depressed. Specifically, as the plunger element 142 is depressed the arcuate segment 150 pivots about the axis 152 so that it engages the propelling pin 154 to rapidly advance the propelling pin 154 upwardly. The propelling pin 154 is positioned so that it is engageable with a game element 20 disposed at a launching or propelling station 158. The propelling station 158 is disposed adjacent the lower end of the channel 36 so that as the game elements 20 gravitate downwardly along the channel 36 they sequentially advance to the propelling station 158. In this connection, as the sequential game elements 20 are advanced downwardly along the channel 36 the lower most game element 20 is free to advance to the propelling station 158. However, the positioning leg 148 engages the next sequential game element 20 to prevent it from engaging the game element 20 located at the propelling station 158 so that the game element 20 located at the propelling station 158 can be propelled upwardly toward the target element 106 by the propelling element 154 without interference from the next sequential game element 20.

Accordingly, for use in operation of the game device 10 a supply of the game elements 20 is positioned in the channel 36 so that one of the game elements 20 gravitates to the propelling station 158 and so that the next sequential game element 20 is retained by the positioning leg 148. The timer assembly 18 is then actuated by moving the knob 58 so that the main winding arm 52 is advanced toward a wound position. As the arm 52 is moved in this manner the fan gear 54 rotates the main drive gear 70 causing the ratchet arms 76 to pass over the inwardly facing gear teeth 80 on the gear ring 78. When the knob 58 is then released so that the timer assembly 18 is advanced toward the unwound position thereof the decay mechanism 42 controls the rate of advancement of the timer assembly 18 toward the unwound position and the shaft 84 is rotated to rotate the cam element 112. As the cam element 112 is rotated in this manner the follower arm 114 and the connecting arm 122 oscillate back and forth so that the actuating member 126 engages the character element 108 to oscillate the receiving wall 100 between the unobstructed position illustrated in FIG. 4 and the obstructed position illustrated in FIG. 5. The propelling mechanism 24 is then operated by depressing the plunger element 142 so that the propelling pin 154 is advanced upwardly into engagement with the game element 20 positioned at the propelling station 158. This causes the game element 20 located at the propelling station 158 to be propelled upwardly toward the target element 106 on the target wall 104. In the event that the receiving wall 100 is in the unobstructed position thereof and the game element 20 is propelled with an appropriate amount of force, the propelled game element 20 can pass into the receiving opening 102. However, if the receiving wall 100 is in the obstructed position thereof or if the game element 20 is propelled with an incorrect amount of force, the propelled game element 20 will strike the receiving wall 100 or the character face element 108 and fall to the side or miss the receiving opening 102. Accordingly, by skillfully operating the plunger element 142 an operator can propel the game elements 20 toward the target element 106 so that they fall into the receiving opening 102. Game elements 20 falling into the receiving opening 102 gravitate downwardly into the interior of the upper housing section 16 so that they are positioned adjacent the door 37 for later retrieval. However, when the timer assembly 18 approaches the fully unwound position thereof the upwardly extending leg 53 engages the downwardly extending leg 140 causing the shut-off arm 134 to be advanced into engagement with the follower arm 114. This causes the connecting arm 122 to be pivoted so that the actuating member 126 engages the character face element 108 to move the receiving wall 100 to the fully obstructed position thereof illustrated in FIG. 5. In addition, this causes the stop lever 128 to engage the stop element 130 causing it to be pivoted upwardly to the position illustrated in FIG. 5 wherein further movement of game elements 20 in the interior of the upper housing section 16 is prevented.

It is seen, therefore, that the instant invention provides an effective amusement game device. The game device 10 is actuatable for set periods of time during which the receiving wall 100 oscillates between obstructed and unobstructed positions. By properly and skillfully manipulating the propelling mechanism 142 during this period of time it is possible to propel the game elements 20 upwardly toward the target element 106 so that they are received in the receiving opening 102. Accordingly, an operator of the game device 10 can generate a game score represented by the number of game elements 20 which are received in the receiving opening 102 while the timer assembly 18 is advanced toward an unwound position. Hence, it is seen that the game device 10 has a high degree of play and amusement value and that it therefore represents a significant advancement in the art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. An action toy game device comprising a base, timer means on said base actuatable for a set period of time, a plurality of game elements, receiving means on said base including a receiving wall having a receiving opening therein, and propelling means for propelling said game elements toward said receiving means so that they are receivable in said receiving opening, said receiving means communicating with said timer means for oscillating said receiving wall between first and second positions wherein said receiving opening is unobstructed and obstructed, respectively, during said set period of time, said receiving wall facing substantially upwardly when said receiving wall is in the first position thereof and facing angularly upwardly and at least partially away from a said propelling means when said receiving wall is in the second position thereof, said receiving means further comprising a substantially vertically disposed stationary target wall and means on said target wall obstructing said receiving opening when said receiving wall is in the second position thereof.

2. In the action toy game device of claim 1, said target wall being substantially stationary with respect to said base.

3. In the action toy game device of claim 1, said receiving wall facing substantially upwardly when said receiving wall is in the first position thereof and pivoting upwardly and away from said propelling means to said second position.

4. An action toy game device comprising a base, timer means on said base actuatable for a set period of time, a plurality of game elements, receiving means on said base including a receiving wall having a receiving opening therein, and propelling means for propelling said game elements toward said receiving means so that they are receivable in said receiving opening, said receiving means communicating with said timer means for oscillating said receiving wall between first and second positions wherein said receiving opening is unobstructed and obstructed, respectively, during said set period of time, said receiving means further comprising a character face element moving with said receiving wall as said receiving wall is moved between the first and second positions thereof, said character face element being exposed when said receiving wall is in the second position thereof and concealed when said receiving wall is in the first position thereof.

5. In the action toy game device of claim 4, said character face element being disposed beneath said receiving wall, said receiving wall facing substantially upwardly when said receiving wall is in the first position thereof and pivoting upwardly and away from said propelling means as said receiving wall is moved toward the second position thereof, said character face element moving upwardly with said receiving wall as said receiving wall is moved toward the second position thereof.

* * * * *